US007874632B2

(12) United States Patent
Bansyo

(10) Patent No.: US 7,874,632 B2
(45) Date of Patent: Jan. 25, 2011

(54) INK JET PRINTER

(75) Inventor: Toshihiro Bansyo, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 152 days.

(21) Appl. No.: 11/637,045

(22) Filed: Dec. 12, 2006

(65) Prior Publication Data

US 2007/0132798 A1 Jun. 14, 2007

(30) Foreign Application Priority Data

Dec. 13, 2005 (JP) ..... 2005-359310

(51) Int. Cl.
*B41J 29/38* (2006.01)

(52) U.S. Cl. ..... 347/13; 347/12; 347/14

(58) Field of Classification Search ..... 347/12–14
See application file for complete search history.

(56) References Cited

U.S. PATENT DOCUMENTS 5,343,231 A * 8/1994 Suzuki ..... 347/14
5,384,587 A * 1/1995 Takagi et al. ..... 347/41
6,312,099 B1 * 11/2001 Hawkins et al. ..... 347/42
6,467,870 B2 * 10/2002 Matsumoto et al. ..... 347/19
6,561,615 B2 * 5/2003 Okawa et al. ..... 347/19
6,793,319 B2 * 9/2004 Ikemoto et al. ..... 347/40

FOREIGN PATENT DOCUMENTS

EP 09014950 * 12/1999

* cited by examiner

*Primary Examiner*—Julian D Huffman
(74) *Attorney, Agent, or Firm*—Manabu Kanesaka

(57) ABSTRACT

In order to settle a phenomenon that a quantity of jetted ink increases at the end of an image and a density increases in a shear-mode ink jet head, in a three-split driven head, a first group prints so that a diameter of a dot is reduced by reducing the quantity of jetted ink as dots at both ends, a second group similarly prints, and a third group also similarly prints. Since three dots at both ends in a main scanning direction of an acquired image are smaller than dots in the middle, the phenomenon that a quantity of jetted ink increases at the end of the image and density increases is reduced.

12 Claims, 8 Drawing Sheets

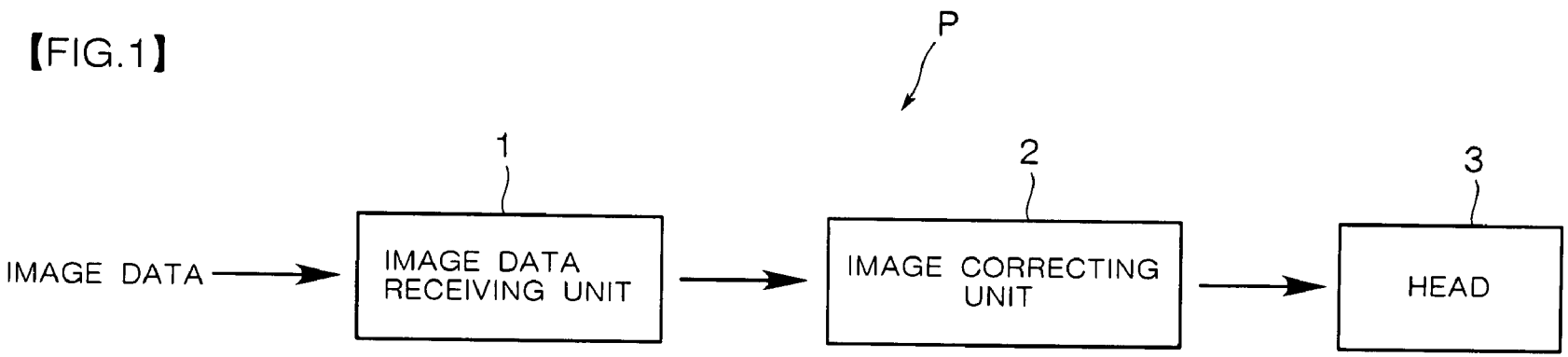
[FIG.1]

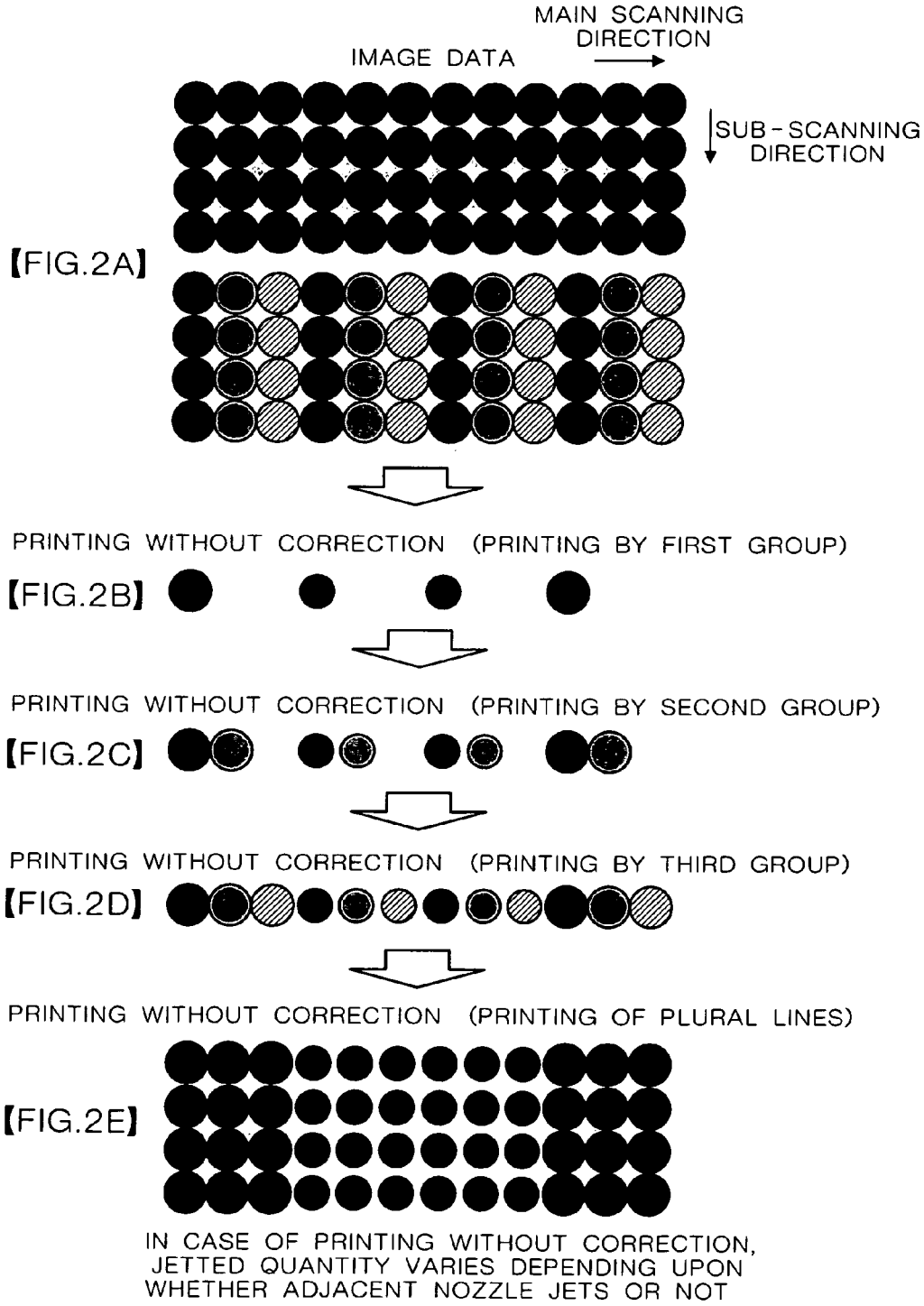
MAIN SCANNING DIRECTION
IMAGE DATA
SUB-SCANNING DIRECTION
【FIG.2A】
PRINTING WITHOUT CORRECTION (PRINTING BY FIRST GROUP)
【FIG.2B】
PRINTING WITHOUT CORRECTION (PRINTING BY SECOND GROUP)
【FIG.2C】
PRINTING WITHOUT CORRECTION (PRINTING BY THIRD GROUP)
【FIG.2D】
PRINTING WITHOUT CORRECTION (PRINTING OF PLURAL LINES)
【FIG.2E】
IN CASE OF PRINTING WITHOUT CORRECTION, JETTED QUANTITY VARIES DEPENDING UPON WHETHER ADJACENT NOZZLE JETS OR NOT

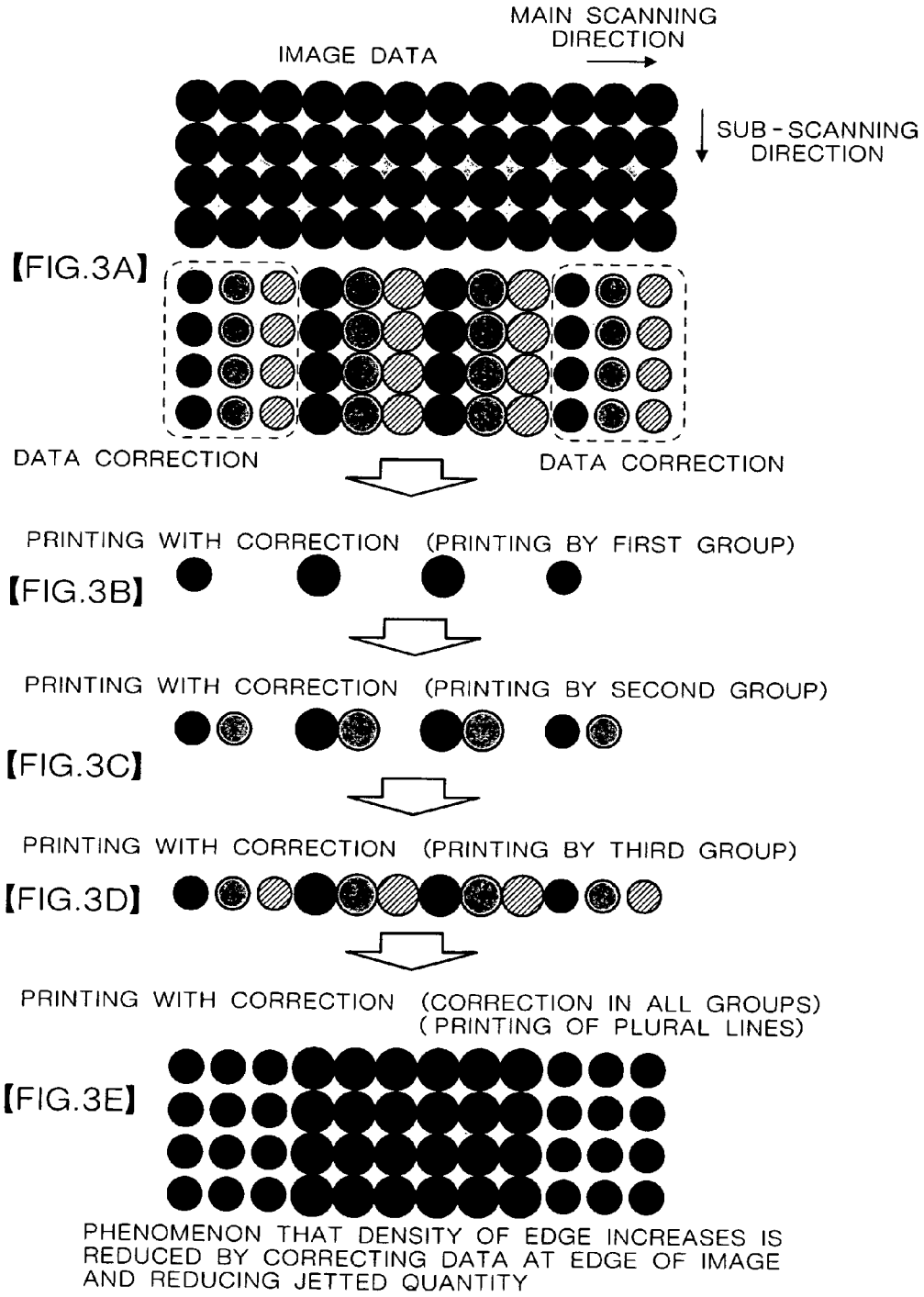
MAIN SCANNING DIRECTION
IMAGE DATA
SUB-SCANNING DIRECTION
【FIG.3A】
DATA CORRECTION
DATA CORRECTION
PRINTING WITH CORRECTION (PRINTING BY FIRST GROUP)
【FIG.3B】
PRINTING WITH CORRECTION (PRINTING BY SECOND GROUP)
【FIG.3C】
PRINTING WITH CORRECTION (PRINTING BY THIRD GROUP)
【FIG.3D】
PRINTING WITH CORRECTION (CORRECTION IN ALL GROUPS)
(PRINTING OF PLURAL LINES)
【FIG.3E】
PHENOMENON THAT DENSITY OF EDGE INCREASES IS REDUCED BY CORRECTING DATA AT EDGE OF IMAGE AND REDUCING JETTED QUANTITY

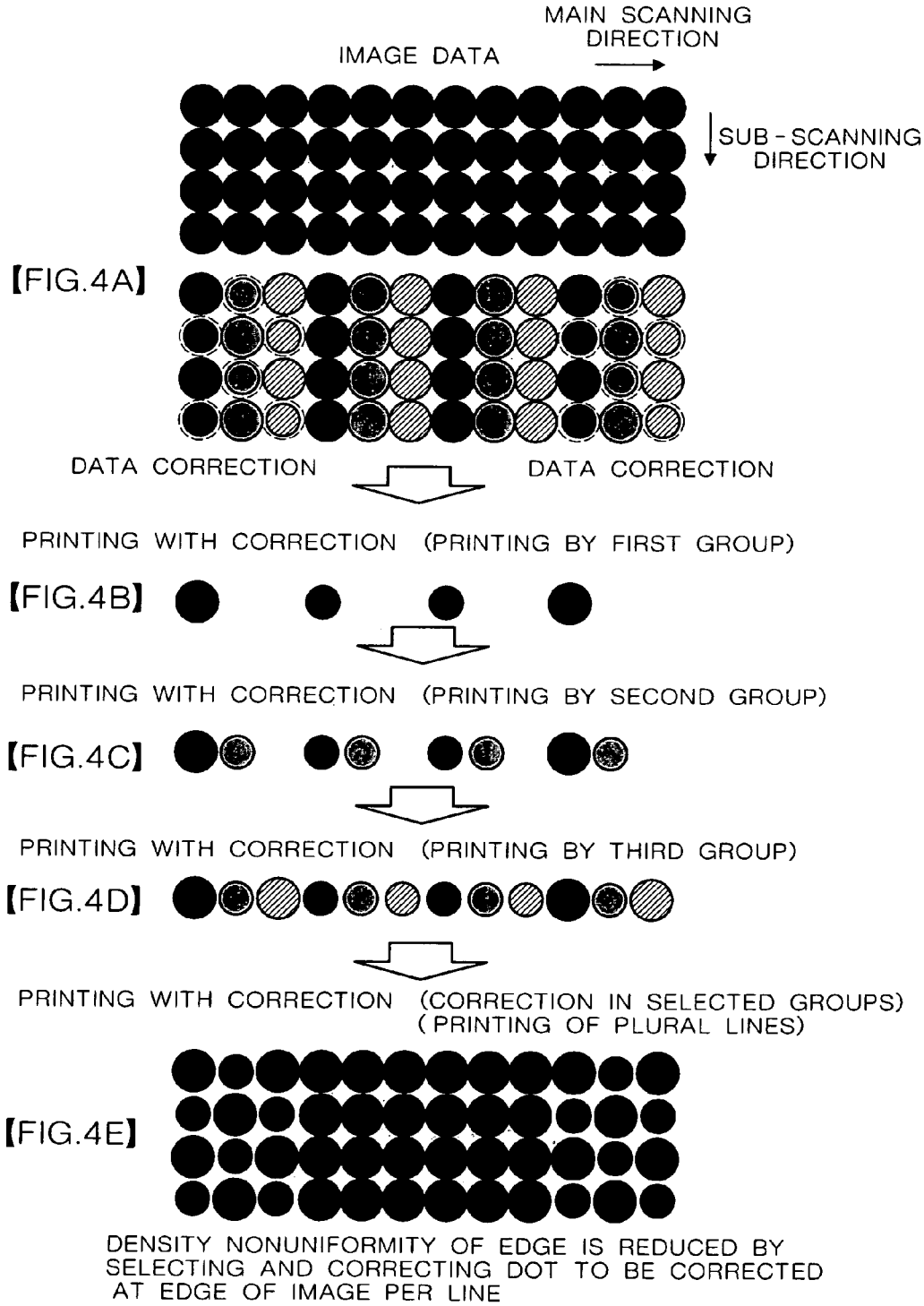
MAIN SCANNING DIRECTION
IMAGE DATA
SUB-SCANNING DIRECTION
【FIG.4A】
DATA CORRECTION
DATA CORRECTION
PRINTING WITH CORRECTION (PRINTING BY FIRST GROUP)
【FIG.4B】
PRINTING WITH CORRECTION (PRINTING BY SECOND GROUP)
【FIG.4C】
PRINTING WITH CORRECTION (PRINTING BY THIRD GROUP)
【FIG.4D】
PRINTING WITH CORRECTION (CORRECTION IN SELECTED GROUPS)
(PRINTING OF PLURAL LINES)
【FIG.4E】
DENSITY NONUNIFORMITY OF EDGE IS REDUCED BY SELECTING AND CORRECTING DOT TO BE CORRECTED AT EDGE OF IMAGE PER LINE

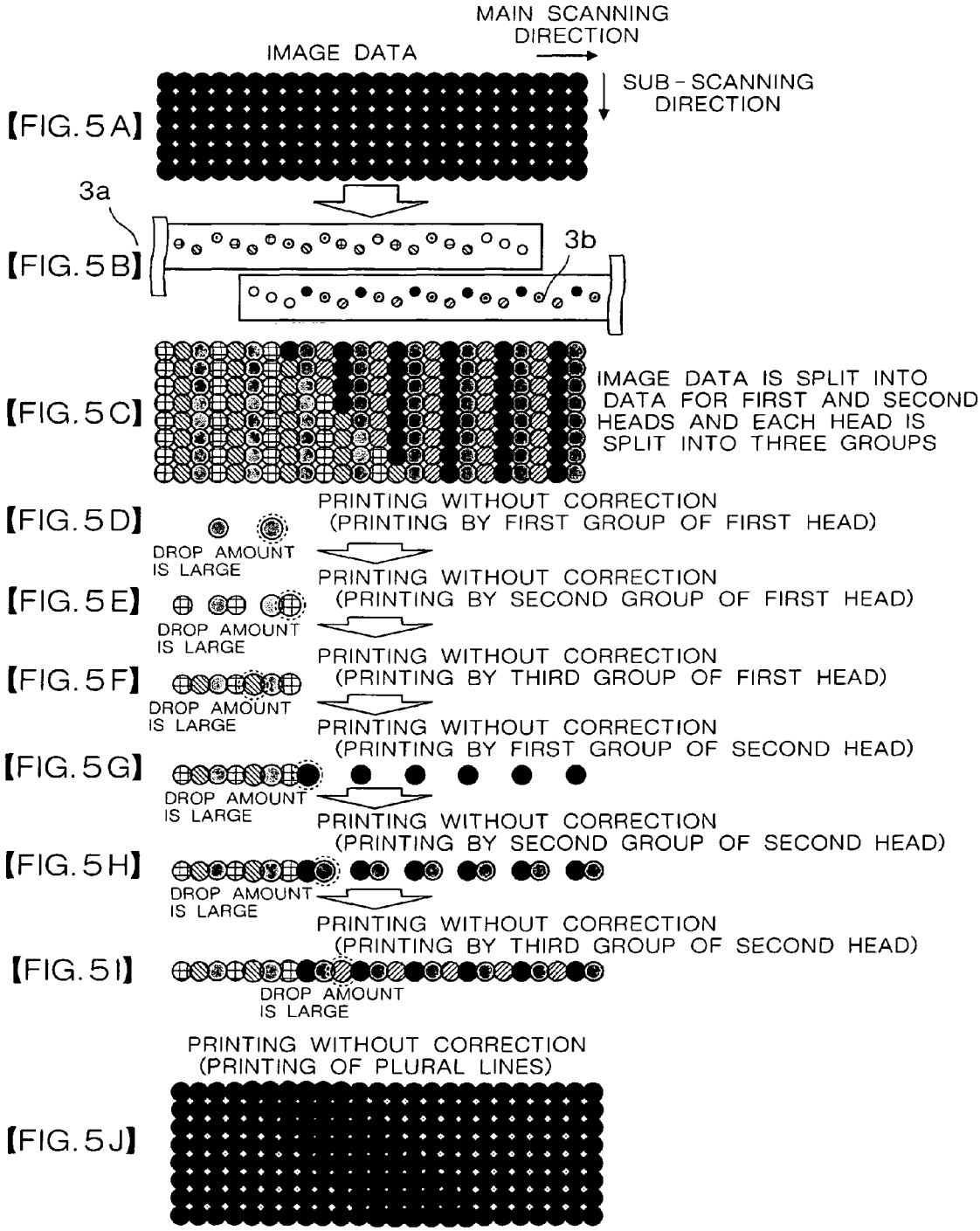
MAIN SCANNING DIRECTION
IMAGE DATA
SUB-SCANNING DIRECTION
【FIG. 5A】
3a
3b
【FIG. 5B】
【FIG. 5C】
IMAGE DATA IS SPLIT INTO DATA FOR FIRST AND SECOND HEADS AND EACH HEAD IS SPLIT INTO THREE GROUPS
【FIG. 5D】
PRINTING WITHOUT CORRECTION (PRINTING BY FIRST GROUP OF FIRST HEAD)
DROP AMOUNT IS LARGE
【FIG. 5E】
PRINTING WITHOUT CORRECTION (PRINTING BY SECOND GROUP OF FIRST HEAD)
DROP AMOUNT IS LARGE
【FIG. 5F】
PRINTING WITHOUT CORRECTION (PRINTING BY THIRD GROUP OF FIRST HEAD)
DROP AMOUNT IS LARGE
【FIG. 5G】
PRINTING WITHOUT CORRECTION (PRINTING BY FIRST GROUP OF SECOND HEAD)
DROP AMOUNT IS LARGE
【FIG. 5H】
PRINTING WITHOUT CORRECTION (PRINTING BY SECOND GROUP OF SECOND HEAD)
DROP AMOUNT IS LARGE
【FIG. 5I】
PRINTING WITHOUT CORRECTION (PRINTING BY THIRD GROUP OF SECOND HEAD)
DROP AMOUNT IS LARGE
【FIG. 5J】
PRINTING WITHOUT CORRECTION (PRINTING OF PLURAL LINES)

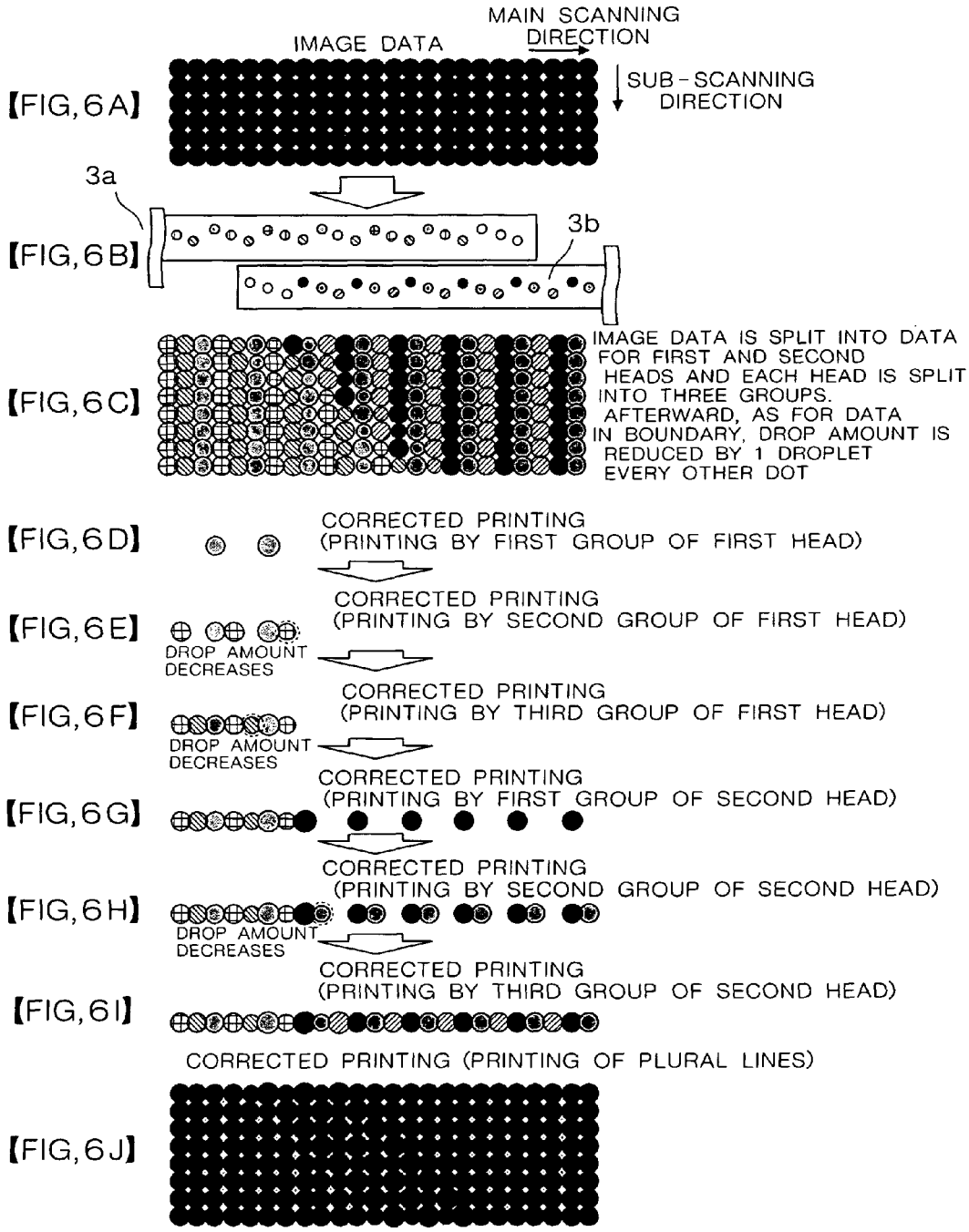
IMAGE DATA
MAIN SCANNING DIRECTION
SUB-SCANNING DIRECTION
【FIG,6A】
3a
3b
【FIG,6B】
【FIG,6C】
IMAGE DATA IS SPLIT INTO DATA FOR FIRST AND SECOND HEADS AND EACH HEAD IS SPLIT INTO THREE GROUPS. AFTERWARD, AS FOR DATA IN BOUNDARY, DROP AMOUNT IS REDUCED BY 1 DROPLET EVERY OTHER DOT
【FIG,6D】
CORRECTED PRINTING (PRINTING BY FIRST GROUP OF FIRST HEAD)
【FIG,6E】
DROP AMOUNT DECREASES
CORRECTED PRINTING (PRINTING BY SECOND GROUP OF FIRST HEAD)
【FIG,6F】
DROP AMOUNT DECREASES
CORRECTED PRINTING (PRINTING BY THIRD GROUP OF FIRST HEAD)
【FIG,6G】
CORRECTED PRINTING (PRINTING BY FIRST GROUP OF SECOND HEAD)
【FIG,6H】
DROP AMOUNT DECREASES
CORRECTED PRINTING (PRINTING BY SECOND GROUP OF SECOND HEAD)
【FIG,6I】
CORRECTED PRINTING (PRINTING BY THIRD GROUP OF SECOND HEAD)
CORRECTED PRINTING (PRINTING OF PLURAL LINES)
【FIG,6J】

【FIG. 7】
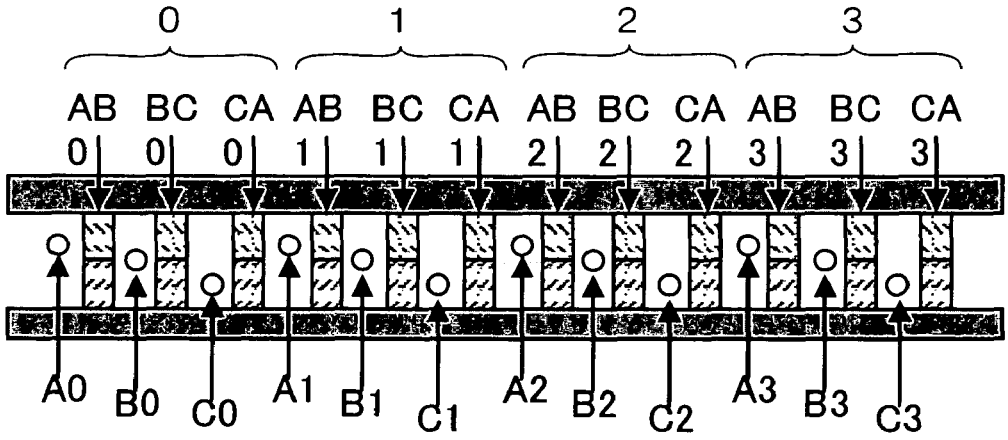

【FIG.8A】
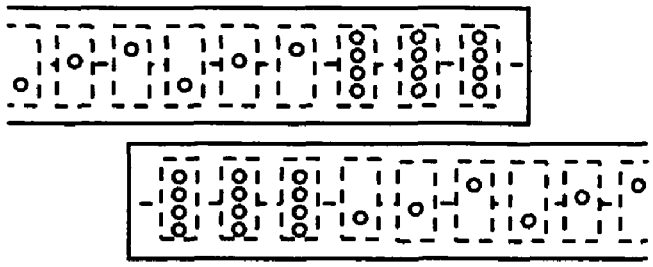
JOINABLE
【FIG.8B】
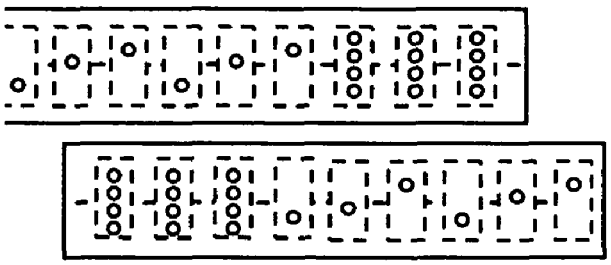
INCONVERTIBLE

INK JET PRINTER

FIELD OF THE INVENTION

The present invention relates to an ink jet printer using a shear-mode ink jet head that corrects density nonuniformity which is apt to be caused at the end of an image and at a joint of a head and can enhance the quality of an image.

BACKGROUND OF THE INVENTION

An ink jet printer that uses a shear-mode ink jet head is known. The shear-mode inkjet head has a two-layer structure in which two piezoelectric members polarized in a mutually opposite direction in a direction of the thickness are pasted via an adhesive, the two piezoelectric members are cut so that multiple grooves pass pasted faces at a fixed interval, a comb structure that the end of each groove is open at the front end of a plate is formed, and the upside of these grooves is closed by another plate. The rear end of each groove communicates with a common ink chamber and an orifice plate having an ink jet (a nozzle) in a position of each groove is provided to an opening at the end. An electrode is provided in the groove.

FIG. 7 is an explanatory drawing for explaining the structure of such a shear-mode ink jet head and a case of a split drive (in FIG. 7, a three-split drive is shown).

FIG. 7 is a schematic drawing showing a pressure chamber corresponding to each nozzle on a plane perpendicular to an ink jet direction, an upper half and a lower half of a wall of each groove functioning as the pressure chamber form two-layer structure in which two piezoelectric members polarized in a mutually opposite direction in a direction of the thickness are pasted, the upper half and the lower half are covered with each plate, and each groove forms the pressure chamber isolated from an adjacent groove.

Referring to FIG. 7, the split drive (in FIG. 7, the three-split drive is shown) of such a shear-mode ink jet head will be described by comparing nozzles that jet at the same time (nozzles A0 to C3 which are shown in FIG. 7 and each of which corresponds to the pressure chamber over ink surrounded by the piezoelectric members) below.

As the shear-mode inkjet head shown in FIG. 7 is driven with it split into three), each nozzle and each pressure chamber are split into three sets of A, B, C. Nozzles of each set are shown in a state in which suffix numbers 0 to 3 showing numbers of the nozzles that belong to each set (in this example, 0 to 3 are added for convenience sake of the drawing and the description) are added. The wall made of piezoelectric material for partitioning the pressure chamber corresponding to each nozzle is shown as AB0, BC0, - - - , BC1, CA2, - - - for example using alphabetical letters showing sets of nozzles adjacent to the wall and the corresponding suffix number. However, in FIG. 7, suffix numbers out of codes showing the walls are collectively shown over a brace over the alphabetical letters.

In FIG. 7, when no ink is jetted from a nozzle A0 and ink is to be jetted from nozzles A1 to A3, the wall on the left side (CAn−1) of each nozzle for ink to be jetted is displaced leftwards, the wall on the right side (ABn) is displaced rightwards, and the corresponding pressure chamber is expanded. As the volume of the ink chamber of the above-mentioned each nozzle is reduced when the displaced walls are restored, ink is jetted from each nozzle.

For an ink jet apparatus utilizing the above-mentioned shear-mode ink jet head, the one disclosed in JP-A-2000-135787 is known.

According to the shear-mode ink jet head, nozzles at both ends out of multiple nozzles arranged in a main scanning direction have a tendency that the quantity of jetted ink is unstable because the nozzles at both ends are different in a condition from inside nozzles surrounded by each nozzle at both ends, the quantity of jetted ink increases at the end of an image and the density increases.

Then, as for an ink jet recording head configured so that plural ink chambers partitioned by partition walls made of piezoelectric material are arranged and ink is jetted from each ink chamber by applying a driving signal to a driving electrode of the partition wall and deforming the partition wall, there is also proposed an idea for solving the above-mentioned problem that a condition of jetting ink for all ink chambers is equalized by making the outside ink chamber a dummy ink chamber and also filling the dummy ink chamber with ink.

However, as no ink chamber exists outside the outermost dummy ink chamber, pressure in an ink chamber inside the outermost dummy ink chamber gets away because of the deformation of an external wall when it is inevitable that the external wall of the dummy ink chamber is deformed because the external wall has only the same thickness as that of each partition wall, and finally, a difference is made between an ink jet characteristic of the inside ink chamber and an ink jet characteristic of the other ink chamber. As a result, it is difficult to completely solve a phenomenon that the quantity of jetted ink increases at the end of an image and the density increases by the above-mentioned shear-mode ink jet head.

In addition, there is another problem that when plural shear-mode ink jet heads described above are used with them arranged, the quantity of jetted ink increases in a boundary between head modules, printing density increases and striped density nonuniformity emerges in a part equivalent to the boundary. Further, in configuration like a line printer, plural heads are arranged in line, however, as adjacent heads are arranged off in a sub-scanning direction so that nozzles for a few dots are overlapped in the sub-scanning direction, the configuration has a problem that the number of dots overlapped at the ends of the heads further increases and density nonuniformity in a boundary between head modules becomes more conspicuous.

FIG. 8 shows the ink jet head disclosed in JP-A-2000-135787 and the quantity of ink jetted from the dummy ink chamber can be matched with that of other ink chambers by providing the dummy ink chamber at the end of the head and driving the dummy ink chamber when ink is jetted from the effective ink chamber on the side of the end of the nozzle. Plural nozzles are provided to the dummy ink chamber, however, no ink is jetted from them. However, in the invention, as shown in FIG. 8A, the ends of adjacent heads can be overlapped in the sub-scanning direction, but a change of joined positions shown in FIG. 8B is impossible.

SUMMARY OF THE INVENTION

The invention is made to solve the problems of the above-mentioned conventional type ink jet head and the object is to settle a phenomenon that the quantity of jetted ink increases at the end of an image and the density increases in a shear-mode ink jet head so as to reduce density nonuniformity. In the shear-mode ink jet head, a phenomenon that the jetted quantity increases at a joint of the head and the density increases occurs, however, the further object of the invention is to settle the phenomenon so as to reduce density nonuniformity.

An ink jet printer disclosed in a first aspect of the invention is based upon an ink jet printer in which plural nozzles of a shear-mode ink jet head are split into plural groups and printing is simultaneously performed per group, and is characterized in that when one nozzle adjacent to a target nozzle out of nozzles that jet ink at the same time as the target nozzle is a non-jet nozzle and a drop amount jetted from the other nozzle adjacent to the target nozzle is the same as a drop amount of the target nozzle, density correction control of reducing the drop amount of the target nozzle is made.

An ink jet printer disclosed in a second aspect is based upon an ink jet printer in which plural nozzles of an ink jet head in a shear-mode are split into plural groups and printing is simultaneously performed per group, and is characterized in that further when the same drop amount is jetted from plural nozzles that belong to another group on a side of jet nozzles while one nozzle adjacent to a target nozzle is a non-jet nozzle and a drop amount jetted from the other nozzle adjacent to the target nozzle is the same as a drop amount of the target nozzle, density correction control of reducing the drop amount of the target nozzle is made.

An ink jet printer disclosed in a third aspect is based upon the ink jet printer disclosed in the first or second aspect, and is characterized in that when the drop amount of the target nozzle is equal to or exceeds a defined drop amount, the drop amount of the target nozzle is compared with a drop amount of an adjacent nozzle and density correction control of further reducing the drop amount of the target nozzle is made.

An ink jet printer disclosed in a fourth aspect is based upon the ink jet printer disclosed in the third aspect, and is characterized in that density correction control is applied to at least one group of plural groups of nozzles.

An ink jet printer disclosed in a fifth aspect is based upon the ink jet printer disclosed in the fourth aspect, and is characterized in that a group to which density correction control is applied is selected per print line.

An ink jet printer disclosed in a sixth aspect is based upon the ink jet printer disclosed in the fifth aspect, and is characterized in that an ink jet head that prints in plural colors is provided and a group to which density correction control per print line is applied is selected per color.

An ink jet printer disclosed in a seventh aspect is based upon the ink jet printer disclosed in the sixth aspect, and is characterized in that an ink jet quantity is variable by varying the number of droplets and density correction control is made by reducing the number of droplets.

An ink jet printer disclosed in an eighth aspect is based upon an ink jet printer which is provided with plural shear-mode ink jet heads, in which plural nozzles of each of the ink jet heads are split into plural groups and in which printing is simultaneously performed per group, and is characterized in that when a drop amount jetted from a nozzle at the end of nozzles that simultaneously jet ink of a first ink jet head and a drop amount of a nozzle of an adjacent second ink jet head that jets ink toward a dot position adjacent to a drop jetted from the nozzle at the end of the first ink jet head are the same, density correction control of reducing a quantity of ink jetted from the nozzle at the end of the first ink jet head is made.

An ink jet printer disclosed in a ninth aspect is based upon an ink jet printer which is provided with plural shear-mode ink jet heads, in which plural nozzles of each of the ink jet heads are split into plural groups and in which printing is simultaneously performed per group, and is characterized in that when a drop amount jetted from a nozzle at the end of nozzles that simultaneously jet ink of a first ink jet head and a drop amount of each of plural nozzles of an adjacent second ink jet head that jet ink toward a dot position adjacent to a drop jetted from the nozzle at the end of the first ink jet head and toward a dot position in an internal direction of the second ink jet head are the same, density correction control of reducing a quantity of ink jetted from the nozzle at the end of the first ink jet head is made.

An ink jet printer disclosed in a tenth aspect is based upon the ink jet printer disclosed in the eighth or ninth aspect, and is characterized in that density correction control is applied to a nozzle at the end of at least one group out of nozzles at the ends of nozzle groups split and simultaneously driven.

An ink jet printer disclosed in an eleventh aspect is based upon the ink jet printer disclosed in the tenth aspect, and is characterized in that a group to which density correction control is applied is selected per print line.

An ink jet printer disclosed in a twelfth aspect is based upon the ink jet printer disclosed in the eleventh aspect, and is characterized in that an ink jet head that prints in plural colors is provided and a group to which density correction control is applied is selected per color.

An ink jet printer disclosed in a thirteenth aspect is based upon the ink jet printer disclosed in the twelfth aspect, and is characterized in that when a drop amount of a nozzle at the end is equal to or exceeds a defined drop amount, density correction control is made.

An ink jet head disclosed in a fourteenth aspect is based upon the ink jet head disclosed in the thirteenth aspect, and is characterized in that a drop amount can be varied by varying the number of multiple droplets and the number of droplets is reduced in density correction control.

BRIEF DESCRIPTION OF THE DRAWINGS

FIG. 1 is a block diagram showing the configuration of an ink jet printer equivalent to a first embodiment;

FIGS. 2A to 2E are dot enlarged views showing a problem caused in the case of printing without correction in the first embodiment;

FIGS. 3A to 3E are dot enlarged views showing a case of printing with correction in the first embodiment;

FIGS. 4A to 4E are dot enlarged views showing a case of printing with correction by another correcting method in the first embodiment;

FIGS. 5A to 5J are dot enlarged views showing a problem caused in the case of printing without correction in a second embodiment;

FIGS. 6A to 6J are dot enlarged views showing a case of printing with correction in the second embodiment;

FIG. 7 is a schematic drawing showing the structure of a shear-mode ink jet head; and FIGS. 8A and 8B are schematic drawings showing a state of the junction of ends of conventional type shear-mode ink jet heads disclosed in JP-A-2000-135787.

DETAILED DESCRIPTION OF THE PREFERRED EMBODIMENTS

Referring to FIGS. 1 to 6J, embodiments of the invention will be described below.

1. First Embodiment

The Invention Related to First to Seventh Aspects

Referring to FIGS. 1 to 5, a first embodiment will be described below. FIG. 1 is a block diagram showing the configuration of an ink jet printer P equivalent to this embodiment, FIGS. 2A to 2E are dots enlarged views showing a problem caused in the case of printing without correction, FIGS. 3A to 3E are dots enlarged views showing a case of printing with correction, and FIGS. 4A to 4E are dots enlarged views showing a case of printing with correction by another correction method.

(1) Configuration

As shown in FIG. 1, this ink jet printer P is provided with an image data receiving unit 1 that receives image data and converts it to data suitable for the formation of an image by an ink jet head, an image correcting unit 2 that corrects the data from the image data receiving unit 1 so as to enable suitably controlling a drop amount of jetted ink and an ink jet head 3 (head 3) that forms an image on paper and others according to the data from the image correcting unit 2 by determining the specified quantity of ink by controlling the number of droplets and jetting it from each nozzle.

The head 3 in this example is provided with multiple nozzles arranged at a predetermined interval in a main scanning direction and these nozzles belong to serial different sets in the main scanning direction. The nozzles that belong to each set are different from the other sets in a position in a sub-scanning direction and the nozzles in each set are serially arranged off by predetermined distance in the main scanning direction. That is, this configuration is based upon configuration where nozzles in each set which are shown in FIG. 8 and to which a split drive is applied are arranged zigzag in the sub-scanning direction and is characterized in that no dummy nozzle is provided. If the head 3 like this is split and driven per set of nozzles and a printed matter such as a sheet and printing paper is moved in the sub-scanning direction with the printed matter synchronized with the head, an ink droplet jetted from each nozzle of each set is arranged in line in the main scanning direction on the sheet and can form one line continuous in the main scanning direction.

In this example, to simplify the drawings and the description, nozzles of one head are split into three and are driven, and formed dots are presented in different modes (painted black, painted pale black and shaded) per nozzle set.

This embodiment relates to the correction of density nonuniformity caused at both ends of an image particularly when an image is formed by the single head 3, a case that no correction for suitably controlling a drop amount of ink is made will be first described as a comparative example, and next, two cases in which correction is made will be described.

(2) Case without Correction

A split mode shown in a lower half of FIG. 2A, that is, a case that a dot sequence arranged in the main scanning direction is formed based upon image data shown in an upper half of FIG. 2A by splitting and driving into three sets of first to third groups will be described below.

As shown in FIG. 2B, the first group is printed. As described in the item of the problem, dots at both ends are larger than dots in the middle.

As shown in FIG. 2C, the second group is printed on the same line in the main scanning direction. Similarly, dots at both ends are larger than dots in the middle.

As shown in FIG. 2D, the third group is printed on the same line in the main scanning direction. Similarly, dots at both ends are larger than dots in the middle.

As shown in FIG. 2E, as for an image acquired as a result, as each three dots at both ends in the main scanning direction of the image are larger than the dots in the middle, the quantity of jetted ink increases at the end of the image and the density increases. That is, when the image is formed without correction, it is unavoidable that density nonuniformity occurs in the image because the quantity of jetted ink varies depending upon whether ink is jetted from an adjacent nozzle or not.

(3) Case with Correction (First Correcting Method)

A dot sequence arranged in the main scanning direction is formed based upon image data shown in an upper half of FIG. 3A by splitting and driving into three sets of first to third groups. In this example, however, as shown by a broken line in a lower half of FIG. 3A, correction is made so that each three dots at both ends in the main scanning direction of an image are slightly smaller.

As shown in FIG. 3B, the first group is printed. As for dots at both ends, the quantity of jetted ink is reduced, compared with dots in the middle by a correcting function of the image correcting unit 2 and as a result, the diameter of the dot at the end is reduced.

As shown in FIG. 3C, the second group is printed. Similarly, as for dots at both ends, the quantity of jetted ink is reduced, compared with dots in the middle by the correcting function of the image correcting unit 2 and as a result, the diameter of the dot at the end is reduced.

As shown in FIG. 3D, the third group is printed. Similarly, as for dots at both ends, the quantity of jetted ink is reduced, compared with dots in the middle by the correcting function of the image correcting unit 2 and as a result, the diameter of the dot at the end is reduced.

As shown in FIG. 3E, as for an image acquired as a result, since each three dots at both ends in the main scanning direction of the image are smaller than the dots in the middle, a phenomenon that the quantity of jetted ink increases at the ends of the image and the density increases is reduced.

(4) Case with Correction (Second Correcting Method)

A dot sequence arranged in the main scanning direction is formed based upon image data shown in an upper half of FIG. 4A by splitting and driving into three sets of first to third groups. In this example, however, as shown by a broken line in a lower half of FIG. 4A, a dot is selected per line and the correction of reducing the jetting of ink is made. The quantity of jetted ink is controlled at three levels by the correction, and for convenience, formed dots are called large-sized, medium-sized and small-sized dots.

As shown in FIG. 4B, the first group is printed. Dots in the middle are formed in medium size by the correcting function of the image correcting unit 2 and uncorrected dots at both ends are formed in large size.

As shown in FIG. 4C, the second group is printed. Dots in the middle are formed in medium size by the correcting function of the image correcting unit 2 and dots at both ends are formed in small size by the correcting function of the image correcting unit 2.

As shown in FIG. 4D, the third group is printed. Dots in the middle are formed in medium size by the correcting function of the image correcting unit 2 and uncorrected dots at both sides are formed in large size.

As described above, one line in the main scanning direction is completed. However, as to a line in the main scanning direction arranged next to this line in the sub-scanning direction, in the first group, dots in the middle are formed in medium size by the correcting function of the image correcting unit 2 and dots at both ends are formed in small size by the correcting function of the image correcting unit 2, in the second group, dots in the middle are formed in medium size by the correcting function of the image correcting unit 2 and uncorrected dots at both ends are formed in large size, in the third group, dots in the middle are formed in medium size by the correcting function of the image correcting unit 2, and dots at both ends are formed in small size by the correcting function of the image correcting unit 2. That is, at both ends of the image, correction control is made so that the size of dots on the second line is reverse to the size of the dots on the first line. Afterward, the control over the second line is repeated.

As shown in FIG. 4E, in the image acquired as a result, as each three dots at both ends in the main scanning direction of the image are formed by suitably combining large-sized dots and small-sized dots, the phenomenon that the quantity of jetted ink increases at the end of the image, compared with the middle and the density increases is reduced and the image having high quality is acquired.

In the first embodiment, density correction control has only to be made over at least one group of plural groups of nozzles. In the case of the ink jet head 3 that prints in plural colors, a group to which density correction control per print line is applied can be selected per color.

2. Second Embodiment

The Invention Related to Eighth to Fourteenth Aspects

Referring to FIGS. 5A to 5J and 6A to 6J, a second embodiment will be described below. FIGS. 5 A to 5J are dots enlarged views showing a problem caused in the case of printing without correction and FIGS. 6A to 6J are dots enlarged views showing a case that the quantity of jetted ink is corrected by a correcting method according to the invention.

(1) Configuration

The whole configuration in this embodiment is substantially similar to that of the first embodiment shown in FIG. 1. However, plural heads 3 each of which is split into three as in the first embodiment are used, as shown in FIG. 5B and FIG. 6B, these are arranged in a main scanning direction, joints are set off in a sub-scanning direction, and each corresponding dot in the similar positions in the main scanning direction of adjacent heads 3*a*, 3*b* is located off by a predetermined dimension in the sub-scanning direction.

This embodiment relates to the correction of density non-uniformity caused at joints particularly when plural heads are used with them joined in the main scanning direction, a case that the correction of suitably controlling a drop amount of ink is not made will be first described as a comparative example, and next, a case that the correction is made will be described.

(2) Case without Correction

Image data shown in FIG. 5A is split between the first head 3*a* and the second head 3*b* as shown in FIG. 5C at joints of the first head 3*a* and the second head 3*b* shown in FIG. 5B, data for each of the heads 3 is split into three sets of first to third groups, the three sets are driven, and an image is formed.

As shown in FIG. 5D, the first group of the first head 3*a* prints without correction. As described in the item of the problem, dots at the end encircled by the broken line (dots on the side close to the second head 3*b*) are larger than inside dots.

As shown in FIG. 5E, the second group of the first head 3*a* prints without correction. Similarly, dots at the end encircled by the broken line are larger than inside dots.

As shown in FIG. 5F, the third group of the first head 3*a* prints. Similarly, dots at the end encircled by the broken line are larger than inside dots.

As shown in FIG. 5G, the first group of the second head 3*b* prints without correction. Similarly, dots at the end encircled by the broken line (dots on the side close to the first head 3*a*) are larger than inside dots.

As shown in FIG. 5H, the second group of the second head 3*b* prints without correction. Similarly, dots at the end encircled by the broken line are larger than inside dots.

As shown in FIG. 5I, the third group of the second head 3*b* prints. Similarly, dots at the end encircled by the broken line are larger than inside dots.

As shown in FIG. 5J, as in an image acquired as a result, each three dots by both heads 3*a*, 3*b*, six dots in total are largish in a part equivalent to the joints of the first head 3*a* and the second head 3*b*, a phenomenon that the quantity of jetted ink increases and the density increases occurs in the part of the image equivalent to the joints.

(3) Case with Correction

Image data shown in FIG. 6A is split between the first head 3*a* and the second head 3*b* as shown in FIG. 6C at joints of the first head 3*a* and the second head 3*b* shown in FIG. 6B, data for each head 3*a*, 3*b* is split into three sets of first to third groups, and an image is formed. As described in detail below, in a boundary between dots formed on a sheet by both heads 3*a*, 3*b* corresponding to the joints of both heads 3*a*, 3*b*, the correction control of reducing the quantity of jetted ink for forming the dots by one droplet every other dot is made.

As shown in FIG. 6D, the first group of the first head 3*a* prints without correction. As described in the item of the problem, dots at the end (dots on the side close to the second head 3*b*) are larger than inside dots.

As shown in FIG. 6E, the second group of the first head 3*a* prints with correction. That is, dots at the end encircled by the broken line are made smaller than inside dots by reducing a drop amount.

As shown in FIG. 6F, the third group of the first head 3*a* prints. That is, dots at the end encircled by the broken line are made smaller than inside dots by reducing a drop amount.

As shown in FIG. 6G, the first group of the second head 3*b* prints without correction. As described in the item of the problem, dots at the end (dots on the side close to the first head 3*a*) are larger than inside'dots.

As shown in FIG. 6H, the second group of the second head 3*b* prints with correction. That is, dots at the end encircled by the broken line are made smaller than inside dots by reducing a drop amount.

As shown in FIG. 6I, the third group of the second head 3*b* prints without correction. As described in the item of the problem, dots at the end (dots on the side close to the second head 3*b*) are larger than inside dots.

As shown in FIG. 6J, as in an image acquired as a result, small dots acquired by reducing a drop amount every other dot are formed in the part equivalent to the joints of the first head 3*a* and the second head 3*b*, the phenomenon that the quantity of jetted ink increases and the density increases is prevented in the part of the image equivalent to the joints and the high quality of image is acquired.

In the second embodiment, density correction control has only to be applied to nozzles at the ends of at least one group out of nozzles at the ends of nozzle groups split and simultaneously driven. A group to which density correction control is applied may be also selected per print line. In the case of the ink jet head that prints in plural colors, a group to which density correction control is applied may be also selected per color.

As clear from the description of the above-mentioned embodiments, according to the invention, the following action and effect are acquired.

A gradation image in which a drop amount gradually varies, a discontinuous color image such as a picture, a fine character and a thin line are not conspicuous even if the density increases in a boundary between images. However, when the same drop amount is continuously jetted as plural dots, the phenomenon that the density of an edge increases is conspicuous.

Then, according to the configuration disclosed in a first aspect of the invention, since the density correction control of reducing a drop amount of a target nozzle is made when one nozzle adjacent to the target nozzle out of nozzles that jet ink at the same time as the target nozzle is a non-jet nozzle, another adjacent nozzle jets ink and its jetted drop amount is the same as a drop amount of the target nozzle, the phenomenon that the density increases at the end of an image can be reduced.

According to the configuration disclosed in a second aspect, since the density correction control of reducing a drop amount of a target nozzle is made when the same drop amount is jetted from plural nozzles on a side of jet nozzles, the phenomenon that the density increases at the end of a solid part having certain width and a half-tone image can be reduced.

Further, when a drop amount is small, density nonuniformity is relatively not conspicuous, but when a slight blank exists between dots and when a dot is embedded between dots, density nonuniformity is conspicuous depending upon whether a blank exists or not or depending upon a degree at which dots overlap.

Then, according to the configuration disclosed in a third aspect, since the drop amount of the target nozzle is compared with a drop amount of an adjacent nozzle and density correction control is made when the drop amount of the target nozzle is equal to or exceeds a defined drop amount, the phenomenon that the density at the end of an image in which density nonuniformity is conspicuous increases can be reduced.

In addition, since density correction control is applied to at least one group out of nozzle groups split and simultaneously driven according to the configuration disclosed in a fourth aspect because the density increases at the end of an image of each split group when a split drive is made, the phenomenon that the density increases at the end of an image by each group to which the split drive is applied can be reduced. When the density of the following dots is too pale because density correction is applied to the dots at the ends of images of all groups, a phenomenon that the density is made too pale by the density correction can be prevented by applying density correction to one or two groups in the case of a three-split drive.

According to the configuration disclosed in a fifth aspect, as a group to which density correction control is applied is selected per print line, a phenomenon that the density regularly increases or decreases can also be prevented.

According to the configuration disclosed in a sixth aspect, as a group to which density correction control is applied is selected per print line per color, the phenomenon that the density regularly increases or decreases can also be prevented.

When the quantity of jetted ink can be varied by adjusting the number of multiple droplets as disclosed in a seventh aspect, density correction control is enabled by only reducing the number of droplets without requiring a complex a driving circuit.

According to the configuration disclosed in an eighth aspect, since the density correction control of reducing a drop amount of a nozzle at the end of the first head is made when the nozzle at the end of the first head jets the same drop amount as a nozzle of the second head for forming a dot adjacent to a dot formed by the nozzle at the end, the phenomenon that the density at the joints increases when the same drop amount is jetted from the first head and the second head can be reduced.

According to the configuration disclosed in a ninth aspect, since the density correction control of reducing the quantity of ink jetted from a nozzle at the end of the first ink jet head is made when a drop amount jetted from a nozzle at the end of nozzles that simultaneously jet ink of the first ink jet head and a drop amount of each of plural nozzles of the adjacent second ink jet head that jet ink toward a dot position adjacent to a drop jetted from the nozzle at the end of the first ink jet head and toward a dot position in an internal direction of the second ink jet head are the same, the density nonuniformity of a solid image having width across the first head and the second head and a halftone image can be reduced.

According to the configuration disclosed in a tenth aspect, as density correction control is applied to a nozzle at the end of each group which is split into plural groups and which prints, the phenomenon caused at the ends of plural groups that the density increases can be reduced.

According to the configuration disclosed in an eleventh aspect, as a group to which density correction control is applied is selected per print line, regular density nonuniformity can be reduced.

According to the configuration disclosed in a twelfth aspect, as a group to which density correction control is applied is selected per color, regular density nonuniformity can be reduced.

According to the configuration disclosed in a thirteenth aspect, density nonuniformity caused in the case of a deep image in which density nonuniformity is conspicuous can be reduced.

According to the configuration disclosed in a fourteenth aspect, as a drop is variably formed by multiple droplets and the number of droplets is reduced in density correction control, density nonuniformity can be reduced without using a complex driving circuit and others.

What is claimed is:

1. An ink jet printer comprising:

a shear-mode ink jet head having a plurality of nozzles split into a plurality of groups for simultaneously printing per group, each of said groups including a target nozzle, a non-jet nozzle located at one side of the target nozzle, and a jet nozzle located at a side opposite to the non-jet nozzle; and a density correction control unit connected to the shear-mode ink jet head for controlling a density of an end of an image to be printed, said density correction control unit implementing fixed correction by reducing a number of droplets ejected from the target nozzle relative to that ejected from the jet nozzle when a drop amount jetted from the jet nozzle is designed to be same as that of the target nozzle so that a phenomenon wherein the density of the end of the image increases can be corrected by correcting an influence acting among the jet nozzle, the non-jet nozzle and the target nozzle.

2. The ink jet printer according to claim 1, wherein when a drop amount of the target nozzle is equal to or exceeds a predetermined drop amount, the drop amount of the target nozzle is compared with the drop amount of the jet nozzle and the density correction control unit further reduces the drop amount of the target nozzle.

3. The ink jet printer according to claim 2, wherein the density correction control unit reduces the number of droplets ejected from the target nozzle in at least one group out of the plurality of groups.

4. The ink jet printer according to claim 3, wherein a group in which the density correction control unit reduces the number of droplets ejected from the target nozzle is selected per print line.

5. The ink jet printer according to claim 4, wherein the shear-mode ink jet head includes the nozzles for a plurality of colors, and a group to which density correction control per print line is applied is selected per color.

6. An ink jet printer, comprising:

a shear-mode ink jet head having a plurality of nozzles split into a plurality of groups for simultaneously printing per group, each of said groups including a target nozzle, a non-jet nozzle located at one side of the target nozzle, and a jet nozzle located at a side opposite to the non-jet nozzle; and a density correction control unit connected to the shear-mode ink jet head for controlling a density of an end of an image to be printed, said density correction control unit implementing fixed correction by reducing a number of droplets ejected from the target nozzle relative to that ejected from the jet nozzle when a drop amount jetted from the jet nozzle is designed to be same as that of the target nozzle, and is also designed to be same as that of a plurality of nozzles of another group on a side of said jet nozzle so that a phenomenon wherein the density of the end of the image increases can be corrected by correcting an influence acting among the jet nozzle, the non-jet nozzle and the target nozzle.

7. An ink jet printer comprising:

a plurality of shear-mode ink jet heads including a first ink jet head and a second ink jet head located adjacent to the first ink jet head, each of the first and second ink jet heads having a plurality of nozzles split into a plurality of groups for simultaneously printing per group, each of said groups including an end nozzle at an end thereof; and a density correction control unit connected to the shear-mode ink jet heads for controlling a density of an image to be printed at a joint of the heads, said density correction control unit implementing fixed correction by reducing a number of droplets ejected from the end nozzle in one group of the first ink jet head when a number of droplets jetted from the end nozzle of the one group of the first ink jet head is designed to be same as that ejected from a nozzle of another group of the second ink jet head that jets ink adjacent to said end nozzle of the first ink jet head so that a phenomenon wherein the density of the image printed at the joint of the heads increases can be corrected by correcting an influence acting among the jet nozzle, the non-jet nozzle and the target nozzle.

8. The ink jet printer according to claim 7, wherein density correction control is applied to the end nozzle of at least one group among the plurality of groups split and simultaneously driven.

9. The ink jet printer according to claim 8, wherein a group to which the density correction control is applied is selected per print line.

10. The ink jet printer according to claim 9, wherein said ink jet heads print a plurality of colors, and a group to which the density correction control is applied is selected per color.

11. The ink jet printer according to claim 10, wherein when the drop amount of the end nozzle is equal to or exceeds a predetermined drop amount, the density correction control is applied.

12. An ink jet printer comprising:

a plurality of shear-mode ink jet heads including a first ink jet head and a second ink jet head located adjacent to the first ink jet head, each of the first and second ink jet heads having a plurality of nozzles split into a plurality of groups for simultaneously printing per group, each of said groups including an end nozzle at an end thereof; and a density correction control unit connected to the shear-mode ink jet heads for reducing a density of an image to be printed at a joint of the heads, said density correction control unit implementing fixed correction by reducing a number of droplets ejected from the end nozzle in one group of the first ink jet head when a number of droplets jetted from the end nozzle of the one group of the first ink jet is designed to be same as that ejected from a nozzle of another group of the second ink jet head that jets ink adjacent to said end nozzle of the first ink jet head and nozzles of the another group of the second ink jet head inside thereof so that a phenomenon wherein the density of the image printed at the joint of the heads increases can be corrected by correcting an influence acting among the jet nozzle, the non-jet nozzle and the target nozzle.

* * * * *